US005511722A

United States Patent [19]

Dixon

[11] Patent Number: 5,511,722

[45] Date of Patent: Apr. 30, 1996

[54] RECLOSABLE FLIP-TOP CARTON

[75] Inventor: Rodney D. Dixon, Burlington, N.C.

[73] Assignee: Mebane Packaging Corporation, Mebane, N.C.

[21] Appl. No.: 342,727

[22] Filed: Nov. 21, 1994

[51] Int. Cl.[6] ..... B65D 5/66; B65D 5/68

[52] U.S. Cl. ..... 229/225; 220/416; 229/146; 229/149; 229/160.1

[58] Field of Search ..... 229/146, 149, 229/150, 160.1, 228, 224–227; 220/416, 418

[56] References Cited

U.S. PATENT DOCUMENTS

| | | | |
|---|---|---|---|
| 2,355,665 | 8/1944 | Mabee | 229/225 |
| 2,361,659 | 10/1944 | Smith | 229/225 |
| 2,836,343 | 5/1958 | Will . | |
| 3,076,590 | 2/1963 | Petryk et al. | 229/225 |
| 3,235,167 | 2/1966 | Svensson | 229/228 |
| 3,270,946 | 9/1966 | Redpath et al. | 229/149 |
| 3,357,631 | 12/1967 | Aid et al. | 229/149 |
| 3,454,212 | 7/1969 | Elward | 229/149 |
| 3,603,502 | 9/1971 | Smyrna et al. | 229/228 |
| 3,910,487 | 10/1975 | Jaeschke . | |
| 3,942,712 | 3/1976 | Bundy et al. | 229/149 |
| 4,948,038 | 8/1990 | Moeller | 229/149 |
| 5,036,982 | 8/1991 | Aston . | |
| 5,105,971 | 4/1992 | Hertenstein et al. | 229/149 |
| 5,154,343 | 10/1992 | Stone | 229/225 |
| 5,203,495 | 4/1993 | Jörgensen-Beck et al. | 229/225 |

FOREIGN PATENT DOCUMENTS

| | | | |
|---|---|---|---|
| 89792 | 8/1967 | France | 229/225 |
| 2229996 | 10/1990 | United Kingdom | 220/416 |
| 9301095 | 1/1993 | WIPO | 229/149 |

*Primary Examiner*—Gary E. Elkins
*Attorney, Agent, or Firm*—Rhodes Coats & Bennett

[57] ABSTRACT

A flip-top reclosable carton for packaging articles. The carton includes front, rear and side wall panels, the side wall panels having generally horizontally slits to form the sides of the flip-top and the rear wall panel being scored to form a hinge between the flip-top and the lower portion of the carton. Top and bottom wall panels are foldably attached to at least one of the front rear and side panels. A perforated tear strip is located on the front panel and extends between the slits in the side panels, whereby removal of the tear strip allows the flip-top to be opened. The tear strip includes an aperture located at one end of the perforated tear strip to permit the one end to be lifted to aid in the removal of the tear strip. In the preferred embodiment, the carton also includes an audible click closure. The closure includes a locking tab formed along the lower front edge of the flip-top and a first inner front panel adjacent to the front panel having an aperture adapted to receive the locking tab.

16 Claims, 4 Drawing Sheets

RECLOSABLE FLIP-TOP CARTON

BACKGROUND OF THE INVENTION (1) Field of the Invention

The present invention relates generally to folding cartons and, more particularly, to a folding carton having a reclosable flip-top.

(2) Description of the Prior Art

U.S. Pat. No. 5,154,343, issued to Stone, discloses an improved, flip-top reclosable carton having opposed top and bottom walls, front and back walls and side walls formed from corresponding panels and flaps. The outer layers of the side walls and the front walls are provided with a horizontal tear strip section for opening the carton from its sealed form. A die cut portion on the interior surface of the front wall includes a flap and an island portion which provides snap ring engagement of the flap and island elements and positive audible feedback indicative of effective carton closure. While the Stone patent generally teaches a flip-top reclosable carton with a tear strip and a audible feedback closure, the structure of the tear strip and the tab lock differ from the present invention.

U.S. Pat. No. 3,910,487, issued to Jaeschke, discloses a carton and blank for making the same. The carton has a lid defined by perforated lines and a hinge line so that the carton may be sealed.

U.S. Pat. Nos. 2,836,343 and 5,036,982 discloses different types of tear strips for a flip-top carton. U.S. Pat. No. 5,203,495 discloses a carton having side edges which lock but does include a tear strip.

Thus, there remains a need for a new and improved flip-top reclosable carton with a perforated tear strip and a click close reclosure device which provides easy access to the product within the package while, at the same time, the audible click close feature assures that the lid will remain closed when used properly. Furthermore, integrity and strength are improved using a three-sided inner partition.

SUMMARY OF THE INVENTION

The present invention is directed to a flip-top reclosable carton for packaging articles. The carton includes front, rear and side wall panels, the side wall panels having generally horizontally extending slits to form the sides of the flip-top and the rear wall panel being scored to form a hinge between the flip-top and the lower portion of the carton. Top and bottom wall panels are foldably attached to at least one of the front rear and side panels.

A perforated tear strip is located on the front panel and extends between the slits in the side panels, whereby removal of the tear strip allows the flip-top to be opened. The tear strip includes an aperture located at one end of the perforated tear strip to permit the one end to be lifted to aid in the removal of the tear strip.

In the preferred embodiment, the carton also includes an audible click closure. The closure includes a locking tab formed along the lower front edge of the flip-top and a first inner front panel adjacent to the front panel having an aperture adapted to receive the locking tab.

Accordingly, one aspect of the present invention is to provide a flip-top reclosable carton for packaging articles. The carton includes: (a) front, rear and side wall panels, the side wall panels having generally horizontally extending slits to form the sides of the flip-top and the rear wall panel being scored to form a hinge between the flip-top and the lower portion of the carton; (b) top and bottom wall panels foldably attached to at least one of the front rear and side panels; and (c) a perforated tear strip located on the front panel and extending between the slits in the side panels, whereby removal of the tear strip allows the flip-top to be opened.

Another aspect of the present invention is to provide a rectangular, parallelepiped, flip-top reclosable carton, formed of a unitary blank of foldable paperboard and having front, rear and side wall panels, the side wall panels having generally horizontally extending slits to form the sides of the flip-top and the rear wall panel being scored to form a hinge between the flip-top and the lower portion of the carton; top and bottom wall panels foldably attached to at least one of the front rear and side panels; and a perforated tear strip located on the front panel and extending between the slits in the side panels, whereby removal of the tear strip allows the flip-top to be opened. The improvement includes an aperture located at one end of the perforated tear strip to permit the one end to be lifted to aid in the removal of the tear strip.

Still another aspect of the present invention is to provide a flip-top reclosable carton for packaging articles. The carton including: (a) front, rear and side wall panels, the side wall panels having generally horizontally extending slits to form the sides of the flip-top and the rear wall panel being scored to form a hinge between the flip-top and the lower portion of the carton; (b) top and bottom wall panels foldably attached to at least one of the front rear and side panels; (c) a perforated tear strip located on the front panel and extending between the slits in the side panels, whereby removal of the tear strip allows the flip-top to be opened, the tear strip including an aperture located at one end of the perforated tear strip to permit the one end to be lifted to aid in the removal of the tear strip; and (d) an audible click closure, the closure including a locking tab formed along the lower front edge of the flip-top and a first inner front panel adjacent to the front panel having an aperture adapted to receive the locking tab.

These and other aspects of the present invention will become apparent to those skilled in the art after a reading of the following description of the preferred embodiment when considered with the drawings.

DESCRIPTION OF THE PREFERRED EMBODIMENTS

Figure 1:
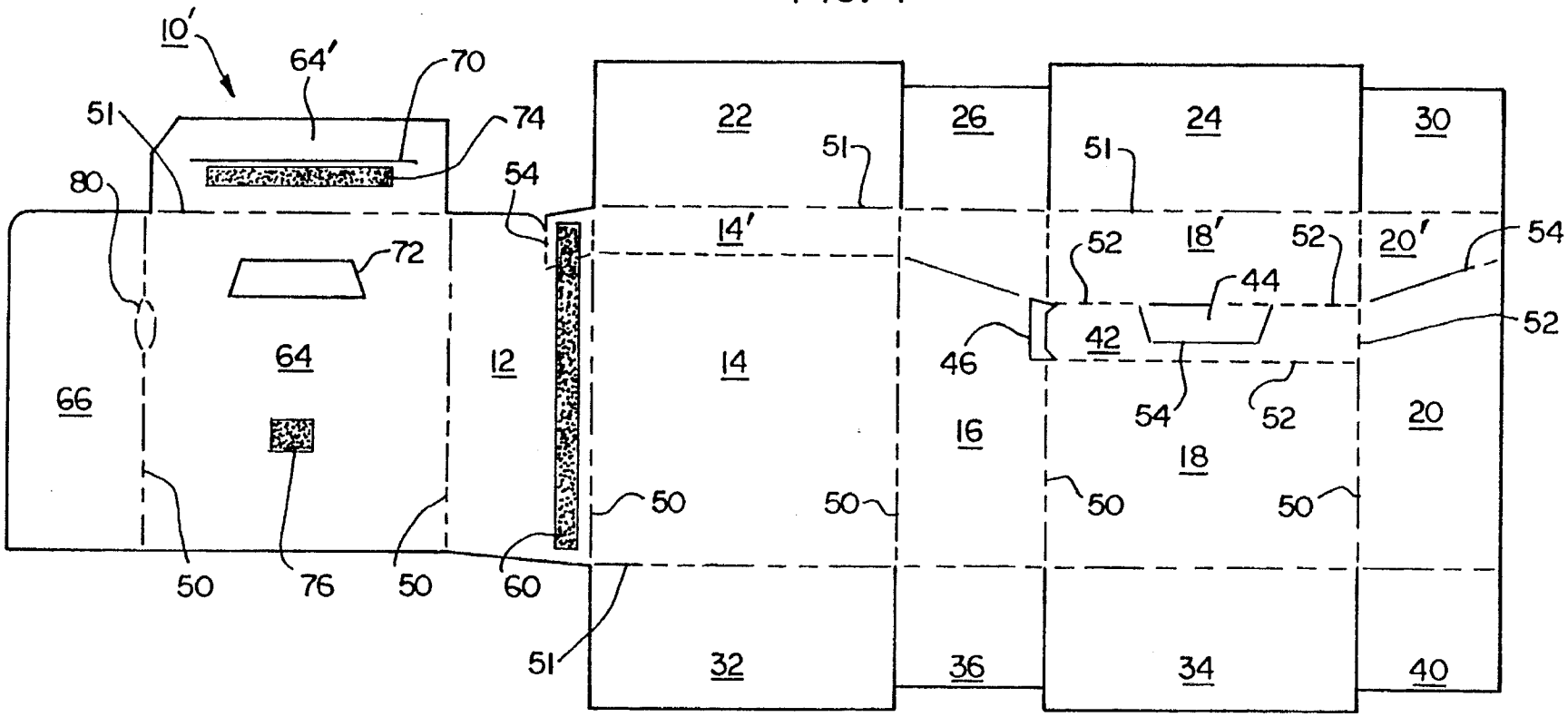
FIG. 1 is a plan view of a blank foldable sheet material from which a carton constructed according to the present inaction may be formed.

In the following description, like reference characters designate like or corresponding parts throughout the several views. Also in the following description, it is to be understood that such terms as "forward", "rearward", "left", "right", "upwardly", "downwardly", and the like are words of convenience and are not to be construed as limiting terms.

Figure 2:
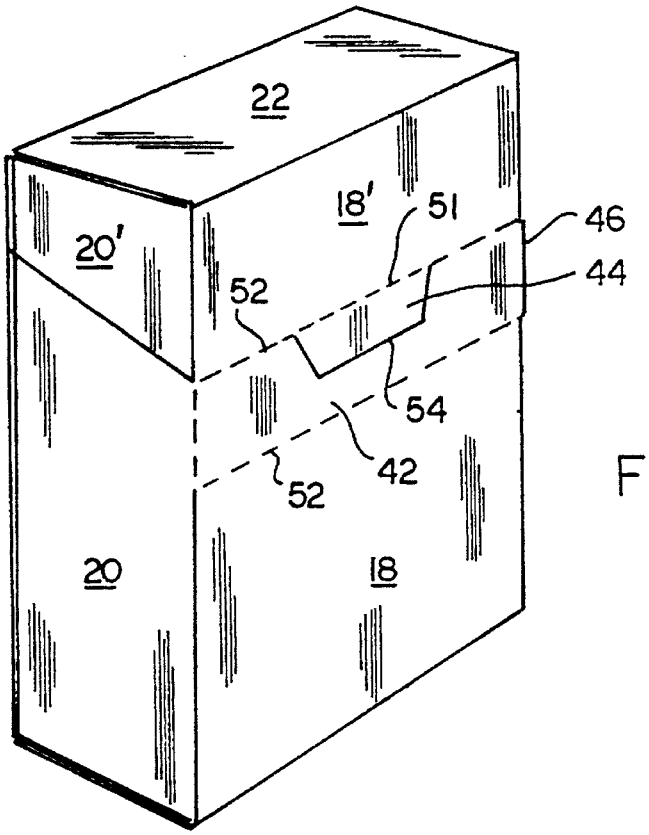
FIG. 2 is a perspective view of the reclosable flip-top carton in its sealed condition.

Referring now to the drawings in general and FIG. 1 in particular, it will be understood that the illustrations are for the purpose of describing a preferred embodiment of the invention and are not intended to limit the invention thereto. As best seen in FIG. 2, a carton constructed according to the present invention, generally designated 10, is a six-sided, parallelepiped enclosure forming a back, front, two sides and a top and bottom. The carton 10 may be formed from a unitary blank of foldable sheet material such as paper board as illustrated in FIG. 1. Bleached sulfate paper board (Caliber 16) has been found to perform satisfactory for lightweight articles. For heavier articles, a heavier paper board (Caliber 24) may be substituted.

Turning now to FIG. 1, the blank forming a carton constructed to the present invention is shown. As can be seen, the blank is in the form of a single planar unitary sheet of cardboard or paper board in which the main body of the carton is formed from five substantially rectangular panels 12, 14, 16, 18, and 20. These panels are linked to each other by means of horizontal folding lines 50 which facilitate folding of the carton panels relative to each other. Each of the five main panels comprising the carton blank is provided with a pair of flaps connected along respective transverse edges by means of corresponding score lines 51 perpendicular to score lines 50. These form first and second top flap 22, 24, first and second end flaps 26, 30, first and second bottom flaps 32, 34, and first and second bottom end flaps 36, 40. When folded and sealed together, this forms a conventional carton which is a six sided, parallelepiped enclosure which may be handled by high speed filling machinery in the conventional manner.

In the present invention, panels 12, 14, 16, 18 and 20 are selectively scored, perforated and cut to form secondary panels 12', 14', 16', 18' and 20'. As will be shown later this arrangement forms a flip-top which, in part, allows the carton to be reclosable. As shown in FIG. 1, in the preferred embodiment lines 54 are substantially complete cut lines and line 56 is a semi-perforated line which forms the hinge of the flip-top when completed.

The front of panel 18 includes a tear-strip 42 formed by perforated lines 52, cut line 54 and aperture 46. A portion of panel 18' extends downward to form locking tab 44.

In one embodiment of the present invention a glue strip or glue line 60 is applied along panel 12 and panels 12, 14, 16, 18 and 20 are assembled in a conventional manner to form a flip-top reclosable carton having an improved tear-strip. However, in the preferred embodiment, blank 10' also includes panels 64 and 66 which are linked together each other by means of vertical score lines 50 and horizontal score line 51.

In the preferred embodiment, flap 64' includes a partial score line 70 to prevent glue from squeezing into tab aperture 72. Flap 64, tab aperture 72 and locking tab 44 cooperate to form the audible click closure of the present invention. Flap 64' is joined to the inside of panel 64 by glue line 74 to form a backing behind tab aperture 72 to prevent material contained in the carton from being spilled inadvertently. Also, in the preferred embodiment, a glue spot 76 may be added to the surface of panel 64 to bond it with panel 18 to further add integrity to the carton. Finally, in the most preferred embodiment, score line 50 located between panel 64 and 66 may be further enhanced by adding elliptical score lines 80 to cooperate with tear-strip 42 and aperture 46 to further facilitate ease of removal of the tear-strip.

Turning now to FIG. 2 there is shown a perspective view of the reclosable flip-top carton 10 in its sealed condition. As can be seen, front panel 18, tear-strip 42, and front panel 18' form a continuous integral surface which protects the contents of the carton. In addition, aperture 46 permits easy access to tear-strip 42.

Figure 3:
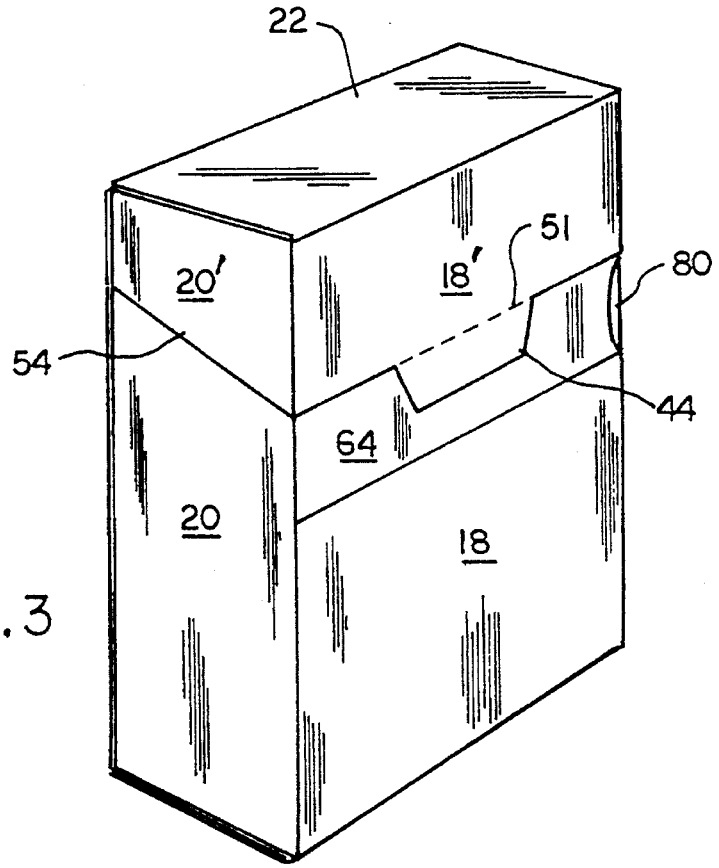
FIG. 3 is a perspective view of the carton shown in FIG. 2 with its tear strip removed to allow opening.

FIG. 3 is a perspective view of the carton shown in FIG. 2 with its tear-strip 42 removed. As can be seen, panel 64 forms a back to panel 18 extending upward and joined by glue spot 76 (not shown) to maintain the integrity of the package.

Figure 4:
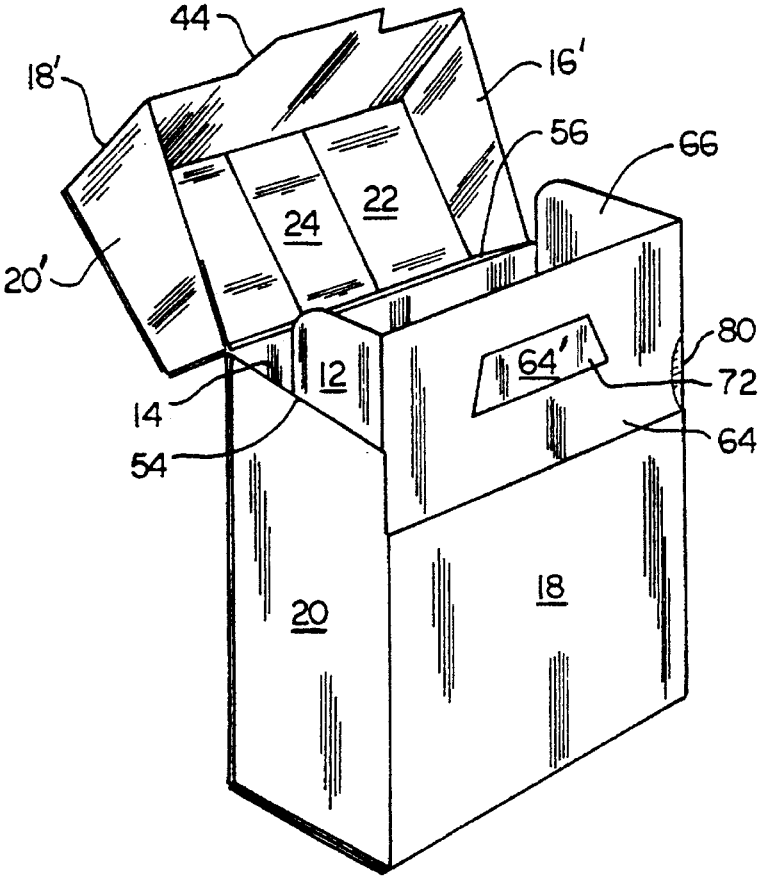
FIG. 4 is a perspective view of the carton shown in FIG. 2 in its opened condition.

FIG. 4 is a perspective view of the carton shown in FIG. 3 in its open condition. As can be seen, panels 18, 64, 64' and side panel 66 and 12 cooperate to ensure integrity of the package in its opened condition.

Figure 5:
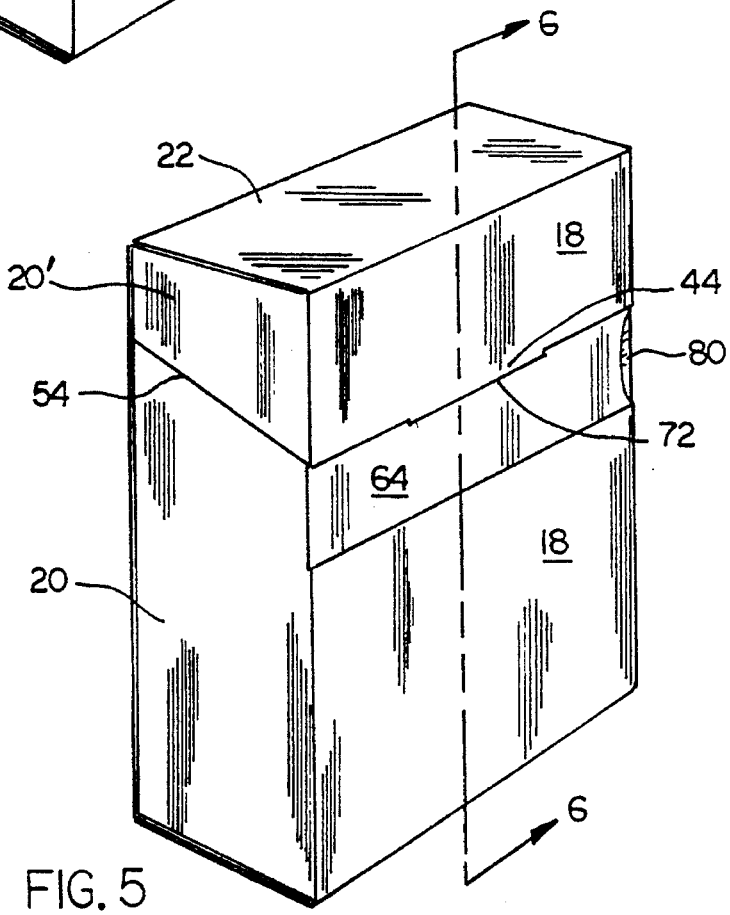
FIG. 5 is a perspective view of the carton shown in FIG. 3 in its reclosed condition.

FIG. 5 is a perspective view of the carton shown in FIG. 4 in its closed position with locking tab 44 being inserted into tab aperture 72.

Figure 6:
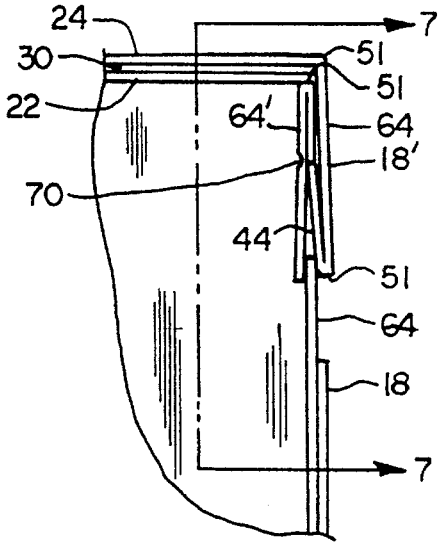
FIG. 6 is an enlarged cross-sectional view of the carton shown FIG. 5 taken along lines 6—6.
Figure 7:
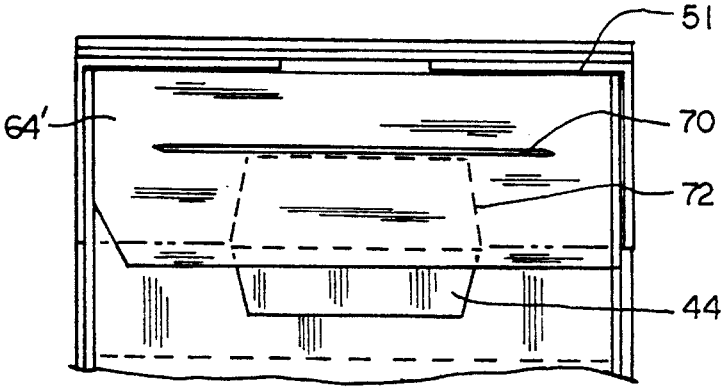
FIG. 7 is an enlarged cross-sectional view of the carton shown in FIG. 6 taken along lines 7—7.

FIG. 6 is an enlarged cross-sectional view of the carton shown in FIG. 5 taken along lines 6—6. As can be seen, panel 64', 18', 64 and 18 cooperate to ensure package integrity by not allowing contents of the package to spill from out through tab aperture 72. In addition, partial score line 70 cooperates with locking tab 44 to provide an audible click closure when the package is reclosed. This feature may best be seen in FIG. 7 which is an enlarged cross-sectional view of the carton shown in FIG. 6 taken along lines 7—7.

Figure 8:
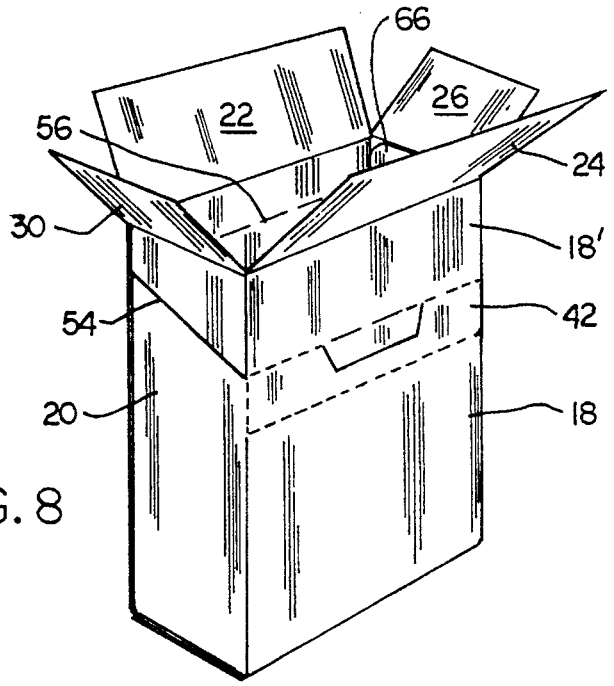
FIG. 8 is a perspective view of the carton shown in FIG. 2 and condition for filling and sealing.

Finally, turning to FIG. 8, there is shown a perspective view of the carton shown in FIG. 2 in condition for conventional filling and sealing. Because of the front panel integrity formed by panels 18, 18' and tear-strip 42, the carton is designed to be compatible with conventional high speed filling machinery.

Certain modifications and improvements will occur to those skilled in the art upon a reading of the foregoing description. By way of example, while paperboard is shown, "B" or microflute board could also be adapted Also, while a seal-end carton is preferred, a tuck-end carton could be substituted. It should be understood that all such modifications and improvements have been deleted herein for the sake of conciseness and readability but are properly within the scope of the following claims.

We claim:

1. A flip-top reclosable carton for packaging articles, said carton comprising:

(a) front, rear and side wall panels, said side wall panels having generally horizontally extending slits to form the side wall panels of a flip-top and said rear wall panel being scored to form a hinge between said flip-top and the bottom portion of said carton;

(b) top and bottom wall panels foldably attached to at least one of said front rear and side panels;

(c) a perforated tear strip located on said front panel and extending between said slits in said side panels, whereby removing said tear strip allows said flip-top to be opened;

(d) a closure, said closure including a locking tab formed along the bottom front edge of said flip-top and a first inner front panel adjacent to said front panel having an aperture adapted to receive said locking tab; and (e) a second inner panel foldably attached along the top edge of said first inner panel and extending below said aperture to overlie said aperture to prevent said articles in said carton from spilling through said aperture.

2. A carton according to claim 1, wherein said second inner panel foldably attached along the top edge of said first inner panel and extending below said aperture to overlie said aperture to prevent said articles in said carton from spilling through said aperture includes a glue strip extending horizontally above said aperture for attaching said second inner panel to said first inner panel.

3. A carton according to claim 1, wherein said second inner panel foldably attached along the top edge of said first inner panel and extending below said aperture to overlie said aperture to prevent said articles in said carton from spilling through said aperture includes a score line extending horizontally above said aperture for preventing glue from squeezing into said aperture.

4. A carton according to claim 1, wherein said top wall panel includes a pair of opposed end flaps foldably attached along the top edges of said side panels and a pair of opposed top flaps foldably attached along the top edges of said front and rear panels.

5. A carton according to claim 1, wherein said bottom wall panel includes a pair of opposed end flaps foldably attached along the bottom edges of said side panels and a pair of opposed bottom flaps foldably attached along the bottom edges of said front and rear panels.

6. A carton according to claim 1, wherein said carton is formed from a unitary blank of foldable paperboard.

7. A blank according to claim 1, further including a third side wall panel and a longitudinal glue strip extending along the length of said third side wall panel for attaching said third side wall panel to another of said side wall panels.

8. In a rectangular, parallelepiped, flip-top reclosable carton, formed from a unitary blank of foldable paperboard and having front, rear and side wall panels, said side wall panels having generally horizontally extending slits to form the side wall panels of a flip-top and said rear wall panel being scored to form a hinge between said flip-top and the bottom portion of said carton; top and bottom wall panels foldably attached to at least one of said front rear and side panels; and a perforated tear strip located on said front panel and extending between said slits in said side panels, whereby removing said tear strip allows said flip-top to be opened, the improvement comprising an aperture located at one end of said perforated tear strip to permit said one end to be lifted to aid in removing said tear strip and further including an elliptical score along the edge connecting one of said side wall panels and said front panel adjacent to said aperture to aid in removing said tear strip.

9. A flip-top reclosable carton for packaging articles, said carton comprising:

(a) front, rear and side wall panels, said side wall panels having generally horizontally extending slits to form the side wall panels of a flip-top and said rear wall panel being scored to form a hinge between said flip-top and the bottom portion of said carton;

(b) top and bottom wall panels foldably attached to at least one of said front rear and side panels;

(c) a perforated tear strip located on said front panel and extending between said slits in said side panels, whereby removing said tear strip allows said flip-top to be opened, said tear strip including an aperture located at one end of said perforated tear strip to permit said one end to be lifted to aid in removing said tear strip;

(d) a closure, said closure including a locking tab formed along the bottom front edge of said flip-top and a first inner front panel adjacent to said front panel having an aperture adapted to receive said locking tab; and (e) a second inner panel foldably attached along the top edge of said first inner panel and extending below said aperture to overlie said aperture to prevent said articles in said carton form spilling through said aperture.

10. A carton according to claim 9, wherein said second inner panel foldably attached along the top edge of said first inner panel and extending below said aperture to overlie said aperture to prevent said articles in said carton from spilling through said aperture includes a glue strip extending horizontally above said aperture for attaching said second inner panel to said first inner panel.

11. A carton according to claim 9, wherein said second inner panel foldably attached along the top edge of said first inner panel and extending below said aperture to overlie said aperture to prevent said articles in said carton from spilling through said aperture includes a score line extending horizontally above said aperture for preventing glue from squeezing into said aperture.

12. A carton according to claim 9, wherein said top wall panel includes a pair of opposed end flaps foldably attached along the top edges of said side panels and a pair of opposed top flaps foldably attached along the top edges of said front and rear panels.

13. A carton according to claim 9, wherein said bottom wall panel includes a pair of opposed end flaps foldably attached along the bottom edges of said side panels and a pair of opposed bottom flaps foldably attached along the bottom edges of said front and rear panels.

14. A carton according to claim 9, wherein said carton is formed from a unitary blank of foldable paperboard.

15. A blank according to claim 9, further including a third side wall panel and a longitudinal glue strip extending along the length of said third side wall panel for attaching said third side wall panel to another of said side wall panels.

16. A carton according to claim 9, further including an elliptical score along the edge connecting one of said side wall panels and said front panel adjacent to said aperture to aid in removing said tear strip.

* * * * *